US006570346B2

(12) United States Patent
Incze

(10) Patent No.: US 6,570,346 B2
(45) Date of Patent: May 27, 2003

(54) CIRCUIT FOR FLASHING FLUORESCENT LAMPS

(75) Inventor: Attilla Incze, Reno, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/767,673

(22) Filed: Jan. 22, 2001

(65) Prior Publication Data

US 2001/0045802 A1 Nov. 29, 2001

Related U.S. Application Data

(60) Provisional application No. 60/177,503, filed on Jan. 21, 2000.

(51) Int. Cl.[7] ..... G05F 1/00

(52) U.S. Cl. ..... 315/291; 315/209 R; 315/105; 315/DIG. 4

(58) Field of Search ..... 315/200 A, 209 T, 315/291, 307, 209 R, 105, 106, DIG. 4, DIG. 5, DIG. 7

(56) References Cited

U.S. PATENT DOCUMENTS

| | | | | |
|---|---|---|---|---|
| 4,673,844 A | * | 6/1987 | Maytum et al. | 257/154 |
| 5,023,521 A | * | 6/1991 | Sridharan | 315/247 |
| 5,111,115 A | * | 5/1992 | Ball et al. | 315/101 |
| 5,854,542 A | | 12/1998 | Forbes | |
| 6,043,615 A | | 3/2000 | Forbes | |

* cited by examiner

*Primary Examiner*—Haissa Philogene
(74) *Attorney, Agent, or Firm*—Ian F. Burns

(57) ABSTRACT

A circuit for flashing a fluorescent lamp. The circuit includes a first and second terminal for coupling the circuit to a fluorescent lamp circuit. The terminals receive an AC power source. A switching circuit is coupled between the first and second terminals for switching the AC power source. An isolation circuit is coupled to the switching circuit. A control circuit is coupled to the isolation circuit. The control circuit controls the switching circuit in response to an external control signal. The circuit can flash higher power rated lamps or multiple lamps.

9 Claims, 2 Drawing Sheets

CIRCUIT FOR FLASHING FLUORESCENT LAMPS

CROSS REFERENCE TO RELATED APPLICATIONS

This application claims priority of and incorporates by reference U.S. provisional patent application No. 60/177,503, filed on Jan. 21, 2000.

BACKGROUND OF THE INVENTION

1. Field of Invention

This invention relates to fluorescent lamps and ballasts and more particularly to a device that works with a ballast for starting and flashing fluorescent lamps.

2. Description of Related Art

Fluorescent lamps are used to provide illumination in various applications such as offices, signs and machinery. The fluorescent light is typically continuously operated in a steady state mode with a constant level of light output. In some applications, it is desirable to flash the fluorescent lamp to act as a signaling device. One such application is in gaming devices. Gaming devices are typically equipped with displays that have a fluorescent lamp located behind a light transmitting panel. In order to promote special operations or bonus opportunities, the fluorescent lamp is flashed.

A fluorescent lamp cannot be turned on and off like a conventional light bulb. The fluorescent lamp is connected to a device called a ballast. The ballast provides a high striking voltage required to initiate an arc across the lamp tube and regulates the current flowing through the arc after it has been struck. One possible solution is to use a new ballast design such as an electronic ballast that supports flashing. A problem with using an entire new type of ballast is that it adds cost and complexity to the machine when it is manufactured or retrofitted. Further, many gaming devices have been, and continue to be, manufactured for non-flashing operation only.

U.S. Pat. Nos. 6,043,615 and 5,854,542 issued to Forbes disclose a device for flashing of fluorescent lamps in a gaming device. The Forbes device uses a DC switched transistor to replace the glow bulb assembly in conventional magnetic ballast. During initial lamp startup, the transistor is on, allowing current to flow through the lamp filaments and heating to occur. Next the transistor is turned off, allowing the ballast inductor to have an inductive voltage spike of approximately 500 volts. The voltage spike in conjunction with the heated filaments is sufficient to ionize the gases in the lamp tube and cause an arc to strike thus lighting the lamp. When the transistor is turned on again, the current preferentially flows through the transistor instead of the arc and the arc is extinguished. Forbes claims that the transistor can be switched to dim the fluorescent lamp. However, the Forbes device has several drawbacks. First, dimming the lamp by repeatedly switching the lamp on and off causes the emissive coating on the lamp filaments to be blasted off and leads to premature lamp failure. Second, the Forbes device is limited in its power handling capabilities to less than 22 watts. When Forbes is used to switch a circuit with a greater amount of power, the transistor is pulled out of saturation and falls into an ohmic state. This causes the transistor to operate as an amplifier, which produces a significant amount heat.

What has long been needed is a device for flashing fluorescent lamps that is adapted to handle a relatively greater amount of power. This would allow multiple lamps to be flashed with the same device. Another long felt need is for a device that can flash fluorescent lamps that is readily usable with currently installed ballasts and that can be manufactured at a low cost. A further long felt need is a device for flashing fluorescent lamps that allows for long lamp life.

SUMMARY OF INVENTION

1. Advantages of the Invention

An advantage of the present invention is that it provides a circuit to repeatedly flash fluorescent lamps.

Another advantage of the present invention is that it provides a circuit that is adapted to flash florescent lamps with relatively high power requirements or multiple lamps.

Yet another advantage of the present invention is that it operates a lower temperature.

A further advantage of the present invention is that it provides a flashing circuit for fluorescent lamp ballasts that can be used with existing magnetic ballast.

An additional advantage of the present invention is that it provides a flashing circuit for fluorescent lamp ballasts that provides long lamp life.

These and other advantages of the present invention may be realized by reference to the remaining portions of the specification, claims, and abstract.

2. Brief Description of the Invention

The present invention comprises a circuit for flashing a fluorescent lamp. The circuit comprises a first and second terminal for coupling the circuit to a fluorescent lamp circuit. The terminals receive an AC power source. First and second switches are provided in series for switching the AC power source. The first and second switches are coupled between the first and second terminals. An isolation circuit is coupled to both the first and second series coupled switches. A control circuit is coupled to the isolation circuit. The control circuit controls the first and second series coupled switches in response to an external control signal. A control terminal is coupled to the control circuit in order to receive the external control signal.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being, practiced and carried out in various ways. Also, it is to be understood that the phraseology and terminology employed herein are for the purpose of description and should not be regarded as limiting.

DESCRIPTION OF THE PREFERRED EMBODIMENT

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made with out departing from the scope of the present invention.

Fluorescent Lamp Circuit

Figure 1:
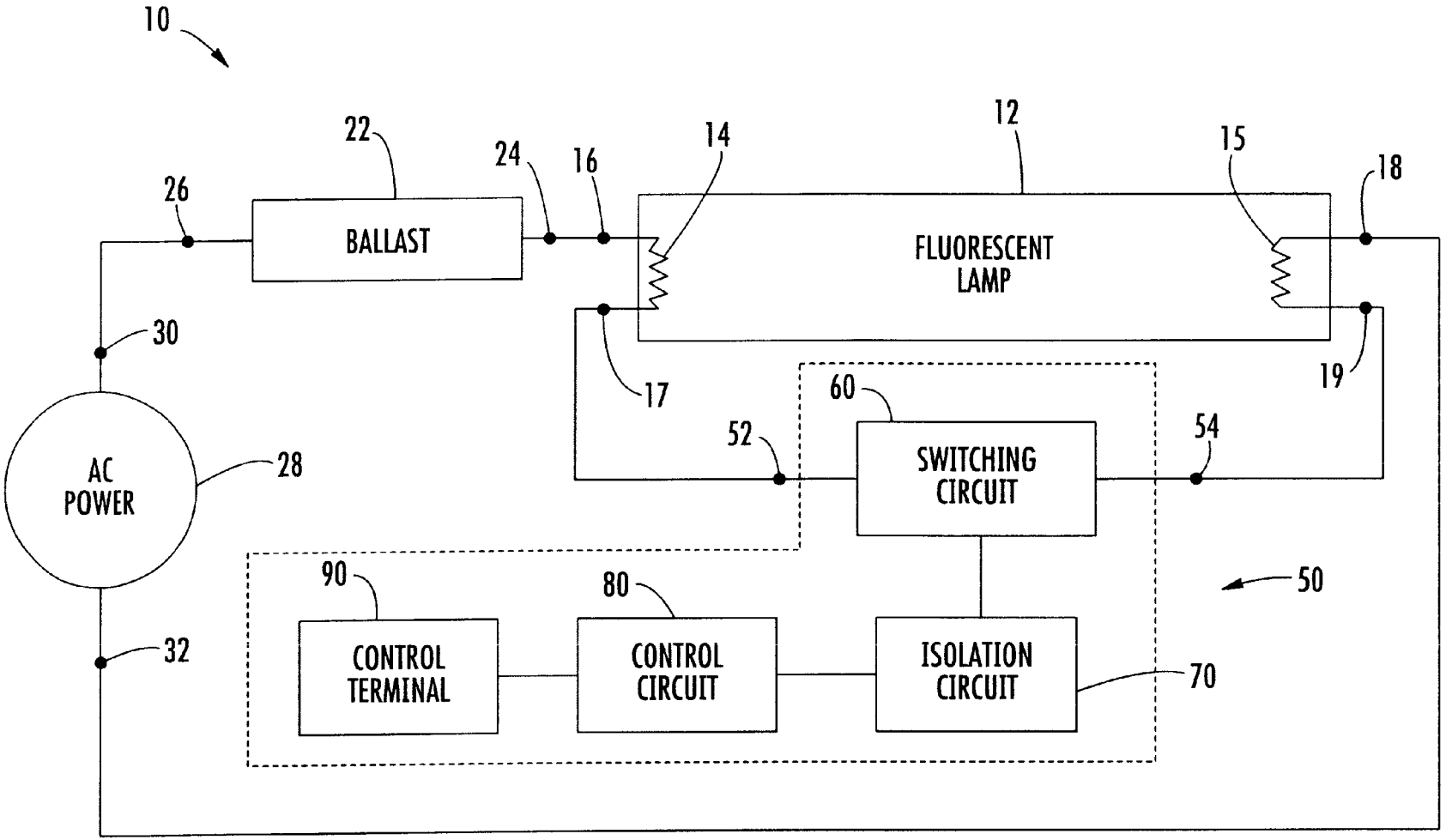
FIG. 1 is substantially a schematic diagram of a fluorescent lamp circuit used with the flashing circuit of the present invention.

Referring now to FIG. 1, the present invention comprises a flashing circuit 50 for use in a fluorescent lamp circuit 10. Fluorescent lamp circuit 10 is adapted for use in a conventional fluorescent lamp fixture such as is commonly found in buildings, signs or in gaming devices. Fluorescent lamp circuit 10 comprises a fluorescent lamp 12, a ballast 22 and an AC power source 28. Fluorescent lamp 12 includes lamp filaments 14 and 15. Lamp filaments 14 and 15 are heated by current flowing through them and cause electrons to be ejected into a gas contained within the lamp tube, thereby providing for striking of a lamp arc at a lower voltage than would otherwise be possible. Lamp filament 14 has terminals 16 and 17. Lamp filament 15 has terminals 18 and 19. Terminals 16, 17, 18 and 19 are used to electrically connect lamp 12 to a power source.

Ballast 22 has terminals 24 and 26. Lamp terminal 16 is electrically coupled to ballast terminal 24. Ballast 22 is a conventional magnetic ballast that has an iron core inductor and a starter socket. Ballast 22 is typically mounted to a light fixture. An AC power source 28 has power terminals 30 and 32. Power source 28 can typically be 120 volts or 277 volts. Ballast terminal 26 is electrically coupled to AC power terminal 30. Lamp terminal 18 is electrically coupled to AC power terminal 32.

Flashing circuit 50 includes terminals 52 and 54 and is electrically connected to lamp 12. Terminal 52 is electrically coupled to lamp terminal 17 and terminal 54 is electrically coupled to lamp terminal 19.

Flashing Circuit

Figure 2:
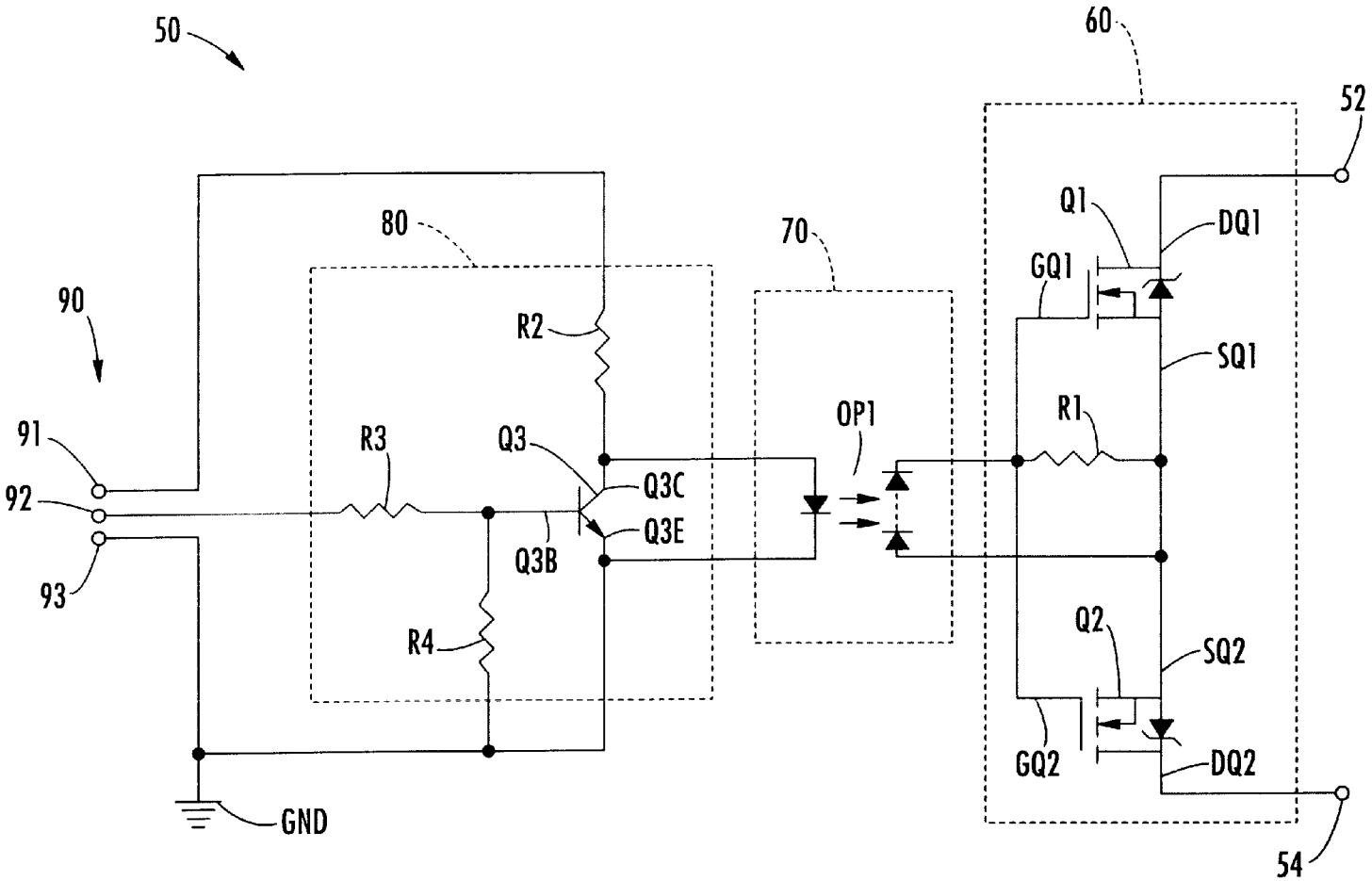
FIG. 2 is substantially a schematic diagram of the flashing circuit of the present invention.

Referring now to FIG. 2, flashing circuit 50 is shown. Flashing circuit 50 comprises a switching circuit 60, an isolation circuit 70, a control circuit 80 and a control terminal 90. Switching circuit 60 is coupled to terminals 52 and 54 which in turn are connected across lamp 12. Switching circuit 60 is coupled to isolation circuit 70. Isolation circuit 70 is coupled to control circuit 80. Control circuit 80 is coupled to control terminals 90.

Switching circuit 60 includes series coupled field effect transistors Q1 and Q2. Field effect transistor Q1 has a source SQ1, a drain DQ1 and a gate GQ1. Similarly, field effect transistor Q2 has a source SQ2, a drain DQ2 and a gate GQ2. Field effect transistors Q1 and Q2 may each be an international rectifier IRF730. The sources SQ1 and SQ2 are tied together. The drains are connected with the AC power source. Drain DQ2 is connected to terminal 54 and drain DQ1 is connected to terminal 52. Gates GQ1 and GQ2 are tied together. A resistor R1 is connected between the commoned gates GQ1, GQ2 and the commoned sources SQ1 and SQ2. Resistor R1 has a typical value of 10 mega-ohms. Transistors Q1 and Q2 switch the AC power source on and off. It is noted that transistors Q1 and Q2 do not require a rectified voltage. During operation, transistors Q1 and Q2 and their anti-parallel or body diodes alternatively conduct one-half of each sine wave of the AC power source 28 applied across terminals 52 and 54. For example, when the AC power source is positive, the body diode of transistor Q1 will be reverse biased and the body diode of transistor Q2 will be forward biased. Current will flow through FET Q1 and the body diode of Q2. When the AC power source is negative, the body diode of transistor Q1 will be forward biased and the body diode of transistor Q2 will be reverse biased. Current will flow through FET Q2 and the body diode of Q1.

Switching circuit 60 can be implemented in other embodiments. For example, switching circuit 60 could be implemented using a triac circuit or a relay.

Isolation circuit 70 includes an photovoltaic isolator OP1 that has an output photodiode stage connected to the gates of transistors Q1 and Q2. The anode is connected to the source Q1 and the cathode is connected to the gate Q2. Photovoltaic isolator OP1 has an input light emitting diode (LED) with an anode and a cathode. The output photodiode stage is connected to the gates of transistors Q1 and Q2. Isolation circuit 70 provides electrical isolation between the high voltage switching circuit 60 and the low voltage control circuit 80.

Control circuit 80 includes a bipolar transistor Q3, and resistors R2, R3, R4. Bipolar transistor Q3 has an emitter Q3E, a collector Q3C and a base Q3B. The emitter Q3E is connected to the cathode of the LED and to ground. The collector Q3C is connected to the anode of the LED and to resistor R2. The base Q3B is connected to the junction of resistors R3 and R4. Resistors R2, R3 and R4 set the bias voltages to switch transistor Q3. Resistor R2 has a typical value of 470 ohms. Resistor R3 has a typical value of 5600 ohms. Resistor R4 has a typical value of 10,0000 ohms.

Control terminal 90 includes terminals 91, 92, and 93. Terminal 91 is connected to resistor R2. Terminal 92 is connected to resistor R3. Terminal 93 is connected to ground and the emitter Q3E. An external control signal is applied to terminals 91 92 and 93. Control terminal 90 can be connected to a lamp regulator circuit (not shown) to provide the external control signal and to regulate the flashing of the fluorescent lamp. The lamp regulator circuit can be a microcontroller or microcomputer. The lamp regulator circuit can be packaged with flashing circuit 50 or may be part of a separate system that is electrically connected to circuit 50 by wires.

The flashing circuit 50 is rated to 5.5 amps at 400 volts. Due to the high power rating of circuit 50, higher rated fluorescent lamps can be flashed.

Lamp Operation Startup

The fluorescent lamp circuit 10 is started according to the following sequential steps:

1. An external control signal is applied to control terminal 90 sufficient to bias transistor Q3 on.
2. Turning on transistor Q3 causes optoisolator OP1 to turn on.
3. Optoisolator OP1 turning on causes transistors Q1 and Q2 to alternatively conduct one-half of each sine wave of the AC power source 28 applied across terminals 52 and 54.
4. AC Current flows through lamp filaments 14 and 15 during a preheat period. At the same time the inductor in ballast 22 is charging a magnetic field.
5. The control signal is removed, turning off transistor Q3 and turning off optoisolator OP1, which causes transistors Q1 and Q2 to be turned off, opening the circuit, collapsing the magnetic field in the ballast inductor and causing an inductive voltage spike of approximately 500 volts. The voltage spike in conjunction with the heated filaments is sufficient to ionize the gases in the lamp tube and cause an arc to strike thus lighting the lamp.

Lamp Operation Flashing

The fluorescent lamp circuit 10 can be flashed according to the following sequential steps assuming that the lamp is already lit:

1. An external control signal is applied to control terminal 90 sufficient to bias transistor Q3 on.
2. Turning on transistor Q3 causes optoisolator OP1 to turn on.
3. Optoisolator OP1 turning on causes transistors Q1 and Q2 to alternatively conduct one-half of each sine wave of the AC power source 28 applied across terminals 52 and 54. The lamp current preferentially flows through transistors Q1 and Q2 instead of the lamp and the lamp arc is extinguished. The lamp is now off.
4. The external control signal is removed from control terminal 90.
5. The startup sequence is now performed. An external control signal is applied to control terminal 90 sufficient to bias transistor Q3 on.
6. Turning on transistor Q3 causes optoisolator OP1 to turn on.
7. Optoisolator OP1 turning on causes transistors Q1 and Q2 to alternatively conduct one-half of each sine wave of the AC power source 28 applied across terminals 52 and 54.
8. AC Current flows through lamp filaments 14 and 15 during a preheat period. At the same time the inductor in ballast 22 is charging a magnetic field.
9. The external control signal is removed, turning off transistor Q3 and turning off optoisolator OP1, which causes transistors Q1 and Q2 to be turned off, opening the circuit, collapsing the magnetic field in the ballast inductor and causing an inductive voltage spike of approximately 500 volts. The voltage spike in conjunction with the heated filaments is sufficient to ionize the gases in the lamp tube and cause an arc to strike thus lighting the lamp.

10. Steps 1–9 are repeated causing the lamp to flash.

The pre-heat step can be eliminated, since the lamp off time is short and the filaments will not cool down during normal operation. The lamp can be flashed at a rate of 1–2 times per second.

Packaging

The flashing circuit 50 can be mounted on a conventional printed circuit board. The circuit board has terminals 52 and 54 located at one end. If desired, the lamp regulator circuit can also be mounted onto the same printed circuit board. The circuit board can be mounted inside a lamp fixture, machine or gaming device.

The flashing circuit 50 provides a simple and inexpensive technique for flashing a fluorescent lamp and can be readily fabricated with commonly available components.

CONCLUSION

The present invention solves many of the problems associated with the prior art. The present invention provides a circuit that can repeatedly flash fluorescent lamps. The present invention provides a flashing circuit for fluorescent lamps that can be used with an existing magnetic ballast. The present invention provides a flashing circuit for fluorescent lamp ballasts that provides long lamp life. The present invention provides a flashing circuit for fluorescent lamp ballasts that has a high power rating and can flash multiple lamps.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A flashing circuit for flashing at least one fluorescent lamp, the fluorescent lamp coupled in series with a ballast and connected across a source of AC power, the flashing circuit comprising:

(A) a control terminal for receiving a control signal;

(B) a control circuit coupled to the control terminal;

(C) an isolation circuit coupled to the control circuit, like isolation circuit comprising a photovoltaic isolator; and (D) a switching circuit coupled to the isolation circuit and across the fluorescent lamp, the switching circuit comprising a first power transistor and a second power transistor, the first and second power transistors being connected in series and being adapted to turn the fluorescent lamp on and off in response to the control signal.

2. The circuit according to claim 1, wherein the control circuit comprises a transistor.

3. The circuit according to claim 1, wherein the first and second power transistors each have a gate, a source and a drain, the gates connected to the isolation circuit, the sources tied together and the drains connected across the lamp.

4. The circuit according to claim 3, wherein the circuit is mounted on a printed circuit board.

5. The circuit according to claim 4, wherein the circuit is located in a gaming device.

6. The circuit according to claim 1, wherein the switching circuit repeatedly turns on and off so as to cause the fluorescent lamp to flash.

7. The circuit according to claim 1, wherein the control terminal is coupled to a lamp regulator circuit.

8. The circuit according to claim 1, wherein the switching circuit comprises a triac.

9. The circuit according to claim 1, wherein the switching circuit comprises a relay.

* * * * *

UNITED STATES PATENT AND TRADEMARK OFFICE

CERTIFICATE OF CORRECTION

PATENT NO. : 6,570,346 B2
DATED : May 27, 2003
INVENTOR(S) : Incze

It is certified that error appears in the above-identified patent and that said Letters Patent is hereby corrected as shown below:

Title page,
Item [75], Inventor, should read -- Attilla Incze, Reno, NV (US); William Bertram, Reno, NV (US) --

Signed and Sealed this

Twenty-third Day of September, 2003

JAMES E. ROGAN
*Director of the United States Patent and Trademark Office*